US008257208B2

(12) United States Patent
Harding

(10) Patent No.: US 8,257,208 B2
(45) Date of Patent: Sep. 4, 2012

(54) SPIN NOCK

(76) Inventor: Martin Dale Harding, Van Alstyne, TX (US)

( * ) Notice: Subject to any disclaimer, the term of this patent is extended or adjusted under 35 U.S.C. 154(b) by 0 days.

(21) Appl. No.: 12/931,894

(22) Filed: Feb. 14, 2011

(65) Prior Publication Data

US 2011/0244997 A1 Oct. 6, 2011

Related U.S. Application Data

(60) Provisional application No. 61/341,885, filed on Apr. 6, 2010, provisional application No. 61/403,904, filed on Sep. 23, 2010.

(51) Int. Cl.
*F42B 6/06* (2006.01)

(52) U.S. Cl. ..... 473/578; 473/586

(58) Field of Classification Search ..... 473/578, 473/585, 586
See application file for complete search history.

(56) References Cited

U.S. PATENT DOCUMENTS 4,978,130 A * 12/1990 Farler ..... 473/586
5,306,020 A * 4/1994 Bolf ..... 473/578
5,823,902 A * 10/1998 Guest et al. ..... 473/578
6,478,700 B2 * 11/2002 Hartman ..... 473/578
7,922,609 B1 * 4/2011 Hajari ..... 473/578

* cited by examiner

*Primary Examiner* — John Ricci
(74) *Attorney, Agent, or Firm* — Jeffrey Roddy

(57) ABSTRACT

A nock for promoting a natural spin on an arrow shaft prior to the nock separating from a bowstring includes a nock segment possessing a bowstring rest portion, and a base portion which is coupled to a retaining portion which is attached to the end of an arrow shaft. The nock segment freewheels independently of the retainer and the arrow shaft to permit the fletching moving through the air to act on the shaft producing a natural spin to the shaft prior to its release from the bow.

3 Claims, 9 Drawing Sheets

12a
12
10'
14a
14
14f
14f
14e

SPIN NOCK

CROSS REFERENCE TO RELATED APPLICATIONS

This Application claims the benefit of Provisional Patent Application No. 61/341,885 filed Apr. 6, 2010, and Provisional Patent Application No. 61/403,904 filed Sep. 23, 2010.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

A bow is a simple machine in which the limbs define a two-arm spring. The energy stored by the archer is in form of the drawn stressed bow. The potential energy is then transferred to the arrow in the form of kinetic energy when the archer releases the bowstring permitting the bow limbs to spring forward.

An arrow consists of a tip which may be a target point type or a broadhead type which is affixed to one end of a shaft which may be composed of wood, fiberglass, metal or other suitable material, a nock for resting against a bowstring, and finally fletching, also known as fins or vanes affixed upon the shaft just ahead of the nock for purposes of aerodynamic stabilization during flight. Among the several factors affecting the distance an arrow flies are the initial angle, the initial velocity, arrow weight, the length of the arrow, and the relative surface area of the arrow fletching.

Spin influences directional stability which is the stability of a moving body about an axis. Drag stability is directional stability produced by the fletching on the arrow shaft. Rate of spin is determined by the vane geometry about the arrow shaft and more specifically to the fletching scheme. Fletching can be straight, offset or helically oriented. Both offset and helical configurations will cause the shaft to spin with a helical configuration producing the highest rate of spin.

When preparing to shoot an arrow, the nock of the shaft is temporarily mounted to the bow string which is drawn back deforming the bow.

Conventional nocks, being fixed to the end of the arrow shaft and necessarily rotating with the arrow shaft, prevent the arrow shaft from assuming a spin while the bowstring is engaged with the nock during the initial release phase of the arrow. It is only after the nock separates from the bowstring that a natural spin can begin to occur. A conventional nock (1) robs the arrow of energy by immobilizing the arrow shaft and accelerating non-spinning fletching forward causing increased air resistance producing drag on the arrow, and (2) interferes with early stabilization that would occur at the onset of release if the arrow were somehow permitted to begin spinning upon release.

What is needed is a nock assembly that permits free rotation of the fletching immediately upon release by not impeding the natural rotation of the shaft imparted by the fletching configuration moving through the air. Such as nock would (1) reduce wind resistance by allowing the fletching to promote a natural spin of the arrow immediately upon release, (2) increase stabilization of the shaft by allowing earlier spin and (3) eliminate string torque which is caused by the non-uniform forces present when those surfaces of a fixed nock contacting the bowstring are forced angularly against the bowstring at release because of the natural tendency of the fletching that wants to begin spinning upon release. Because the nock is radially torqued against the bowstring by the rotational tendencies of the fletching acting on the shaft, the torquing slightly readjusts the path of the arrow shaft at that moment in time where the nock and the bowstring actually separate. Finally, for at least the reasons given above, a nock permitting the free rotation of an arrow shaft while still contacting a bowstring would, assuming the same shooter and gear, provide a relatively greater degree of precision.

SUMMARY OF THE INVENTION

1. Objectives of the Invention

It would be desirable to promote a natural spin to an arrow shaft by the rotation of the fletching during the initial acceleration phase of an arrow's release.

It would be desirable to reduce the drag upon the fletching of an arrow during the initial acceleration phase of an arrow's release and from that time immediately after the initial acceleration phase when the arrow separates from the bow string until the fletching is able to adequately rotate the shaft.

It would be desirable to increase the travel for a released arrow.

It would be desirable to increase the stability of an in-flight arrow.

It would be desirable to improve the accuracy of an arrow by means of the foregoing objectives.

2. Statement of the Invention

The present invention relates generally to arrow shafts, and more specifically to a nock assembly that includes a nock portion 12 with a bowstring seat 12*a* and nock base 12*b*, and a nock retainer 14 including an upper collar 14*a* and a lower portion, or bottom 14*e*, for coupling the nock to an arrow shaft. The collar portion 14*a* is generally tubular with at least one inwardly directed circumferential lip 14*c* interlocked with the nock base 12*b* which is freely spinable within the collar 14*a*. The bottom of the retainer 14*e* beneath the collar is inserted into a recess or hollow at one end of an arrow shaft. Although prior to assembly, the collar and the retainer bottom 14*e* are preferably separate, the collar portion 14*a* is joined with the retainer bottom 14*e* through gluing or sonic welding or other appropriate means. The retainer bottom and the collar are prevented from rotating relative to the arrow shaft by a number of protrusions or tabs 14*f* on the outside of the retainer bottom which are friction fitted into the shaft recess by pressing the retainer bottom 14*e* into the shaft end.

In one aspect of the present invention, the circumferential lip 14*c* retains the nock base within the collar 14*a* and the nock bottom 12*d* rotates upon the uppermost surface of the bottom portion 14*e*.

In yet another aspect, a thrust bearing 22 resides between a portion the nock base and the retainer bottom.

In either aspect, the nock 12 can freewheel independently of the retainer 14 having spacing means both aligning the nock coaxially with the arrow shaft and separating the nock base from the retainer. The spacing means can be ribbing 12*c* on the outer surface of the nock base having a low coefficient of friction, or ribbing combined with a thrust bearing 22 residing between the nock base 12*b* and the retainer. Because the nock freewheels, the arrow shaft 16 is permitted to begin rotation even prior to separating from the bowstring because the bowstring, while supplying forward momentum, can no longer impede the natural rotation of the shaft produced by the vanes or fletching 18 moving through the air. The result is a spinning force upon the shaft consistent with the shaft velocity, vane configuration and wind resistance, causing the entire arrow to begin its spin earlier than what is possible with previous devices.

The result of the foregoing construction and according to the present invention, is a nock that allows the shaft to spin freely prior to exiting the bow so that the vanes may assume a natural spin upon release which reduces drag upon the arrow while promoting stabilization. Essentially, the present invention allows spin to naturally occur, rather than actively applying the force to the arrow by torquing or other means.

While examples discussed herein are directed generally to a spin-able nock for an arrow, the description that follows is not intended to limit the scope of the invention to the particular forms set forth, but on the contrary, it is intended to cover such alternatives, modifications, combinations and equivalents as may be included within the spirit and scope of the invention as set forth in the detailed description of the embodiments.

DETAILED DESCRIPTION OF THE EMBODIMENTS

Reference Listing

Figure 1:
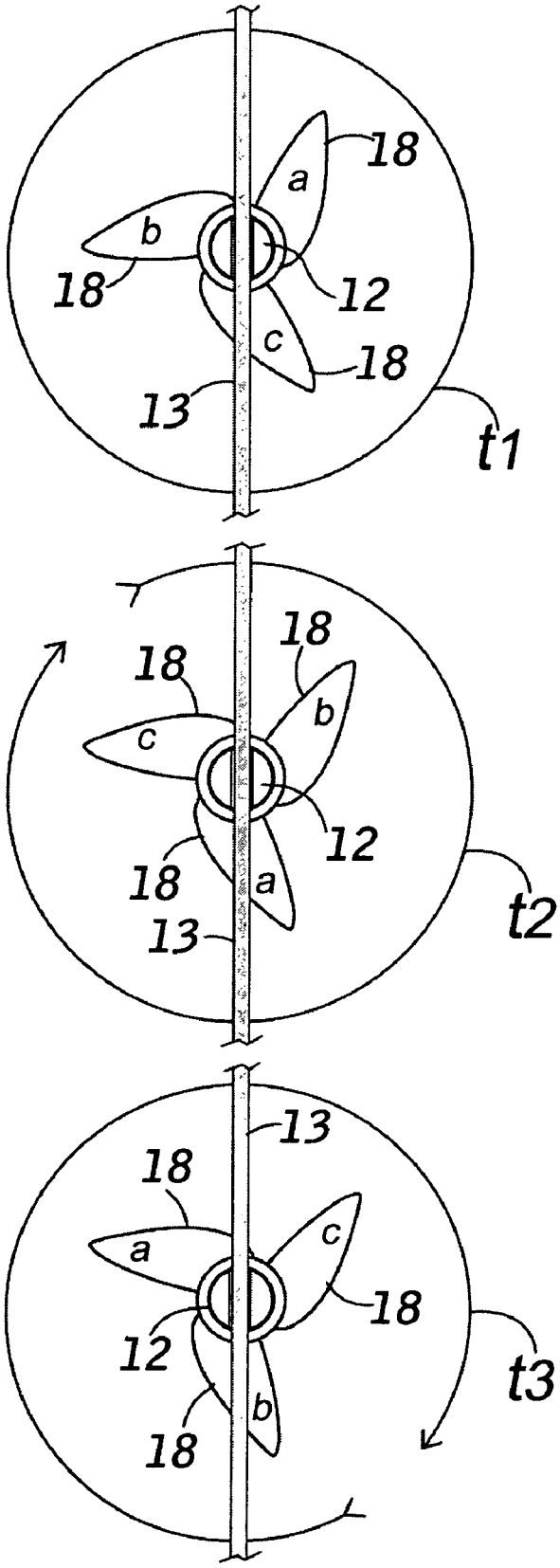
FIG. 1 depicts a release sequence (t1, t2, t3) showing a preferred embodiment from the engaged end of the nock.
Figure 2:
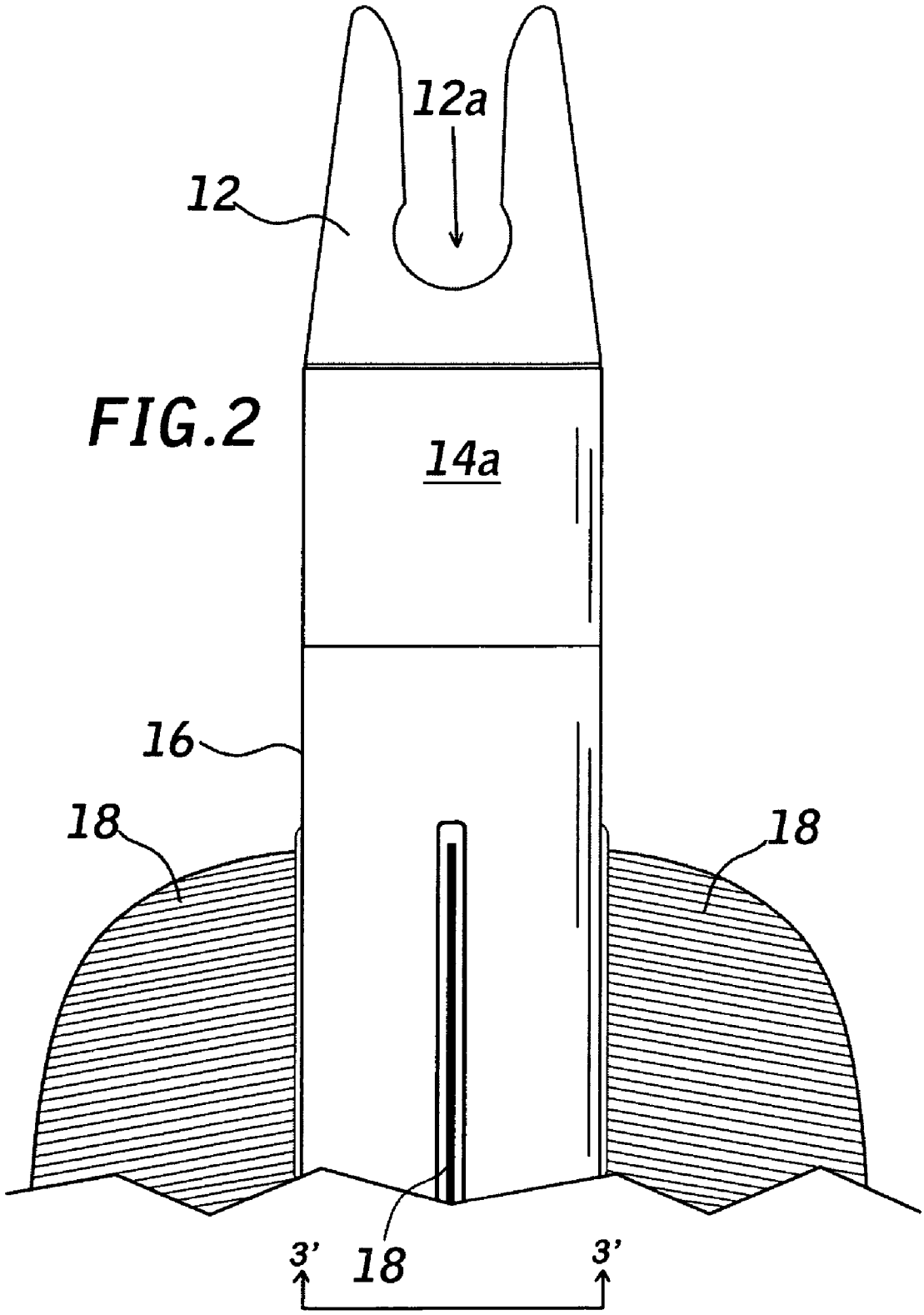
FIG. 2 is a plan view of a preferred embodiment according to the present invention depicting a nock assembly with a nock 12, and a collar mounted to an arrow shaft 20.
Figure 3:
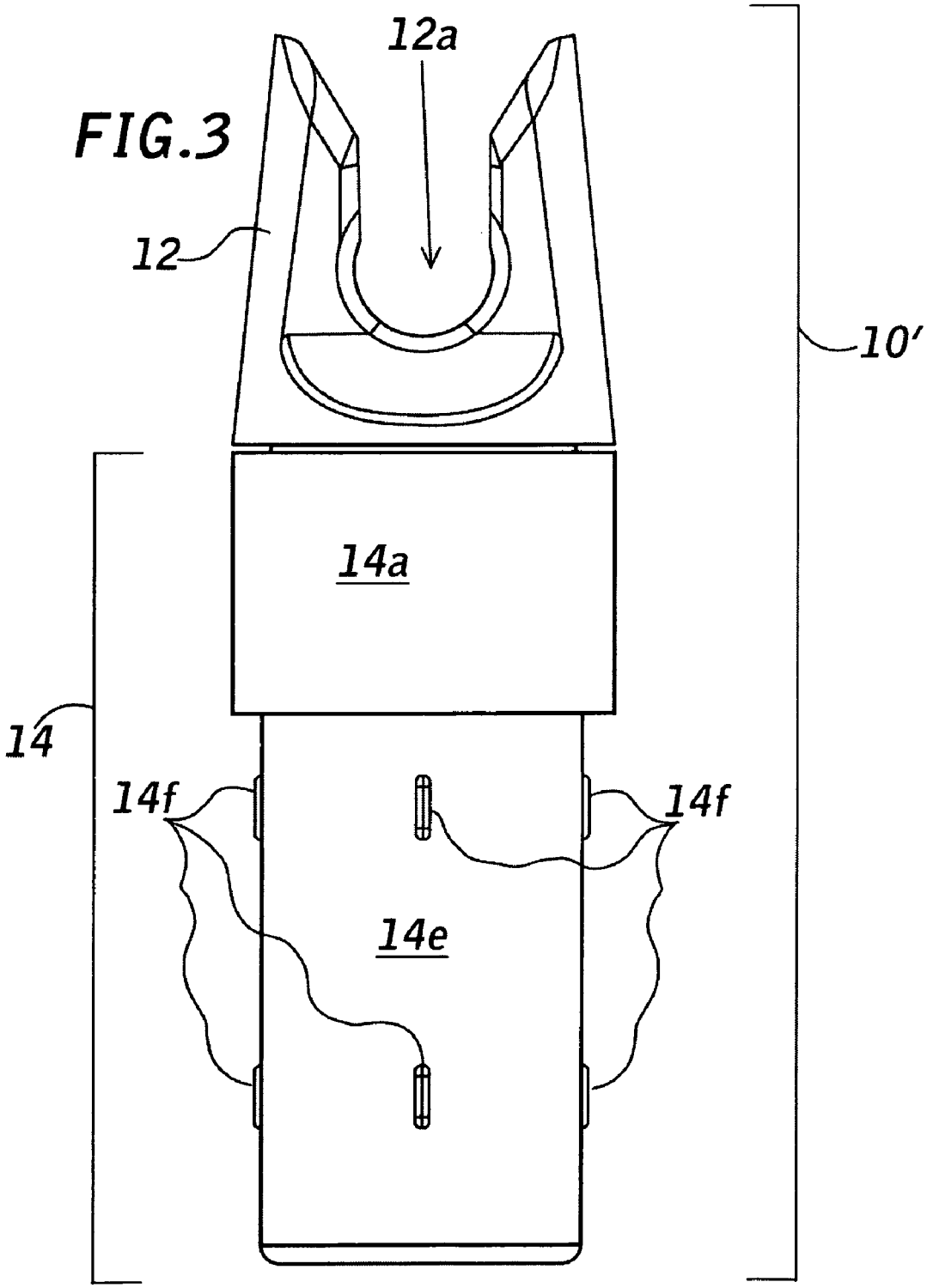
FIG. 3 is a plan view of a preferred embodiment according to the present invention depicting the nock assembly, including a nock 12, a collar 14 and a retainer bottom 14*e;*
Figure 4:
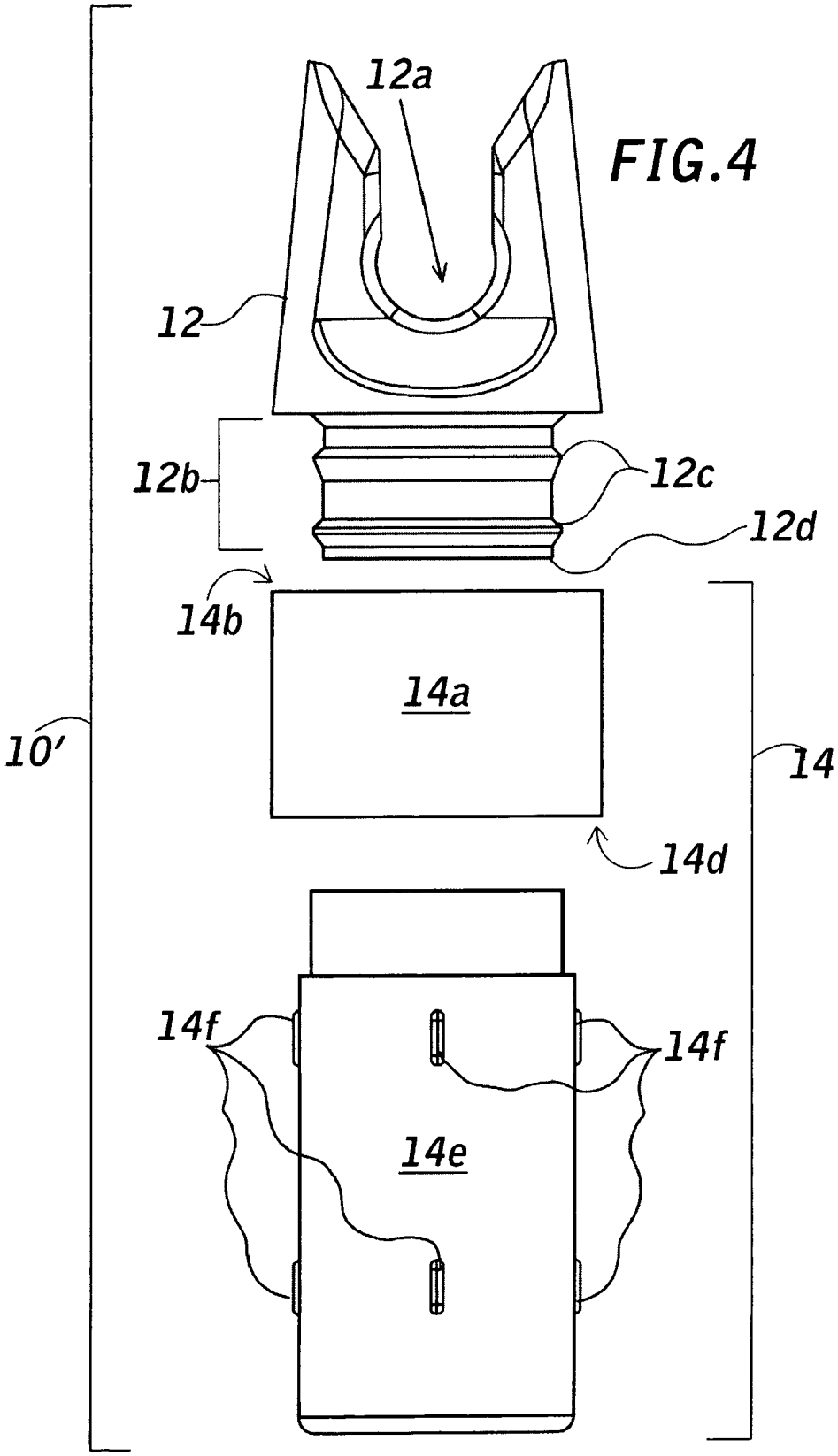
FIG. 4 is an exploded view of the embodiment depicted in (FIG. 3)
Figure 5:
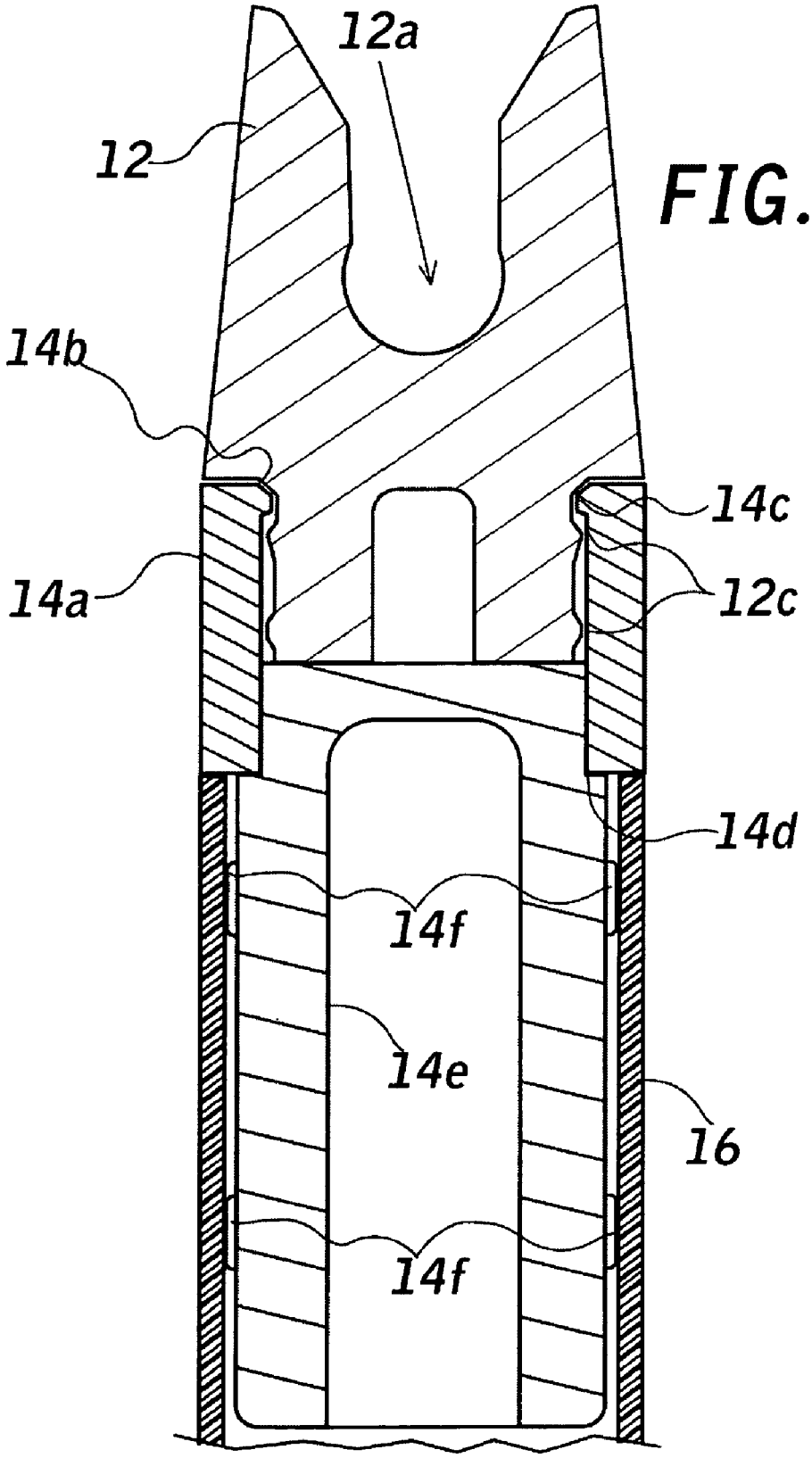
FIG. 5 is a sectional view taken along lines 3'-3' of (FIG. 2)
Figure 6:
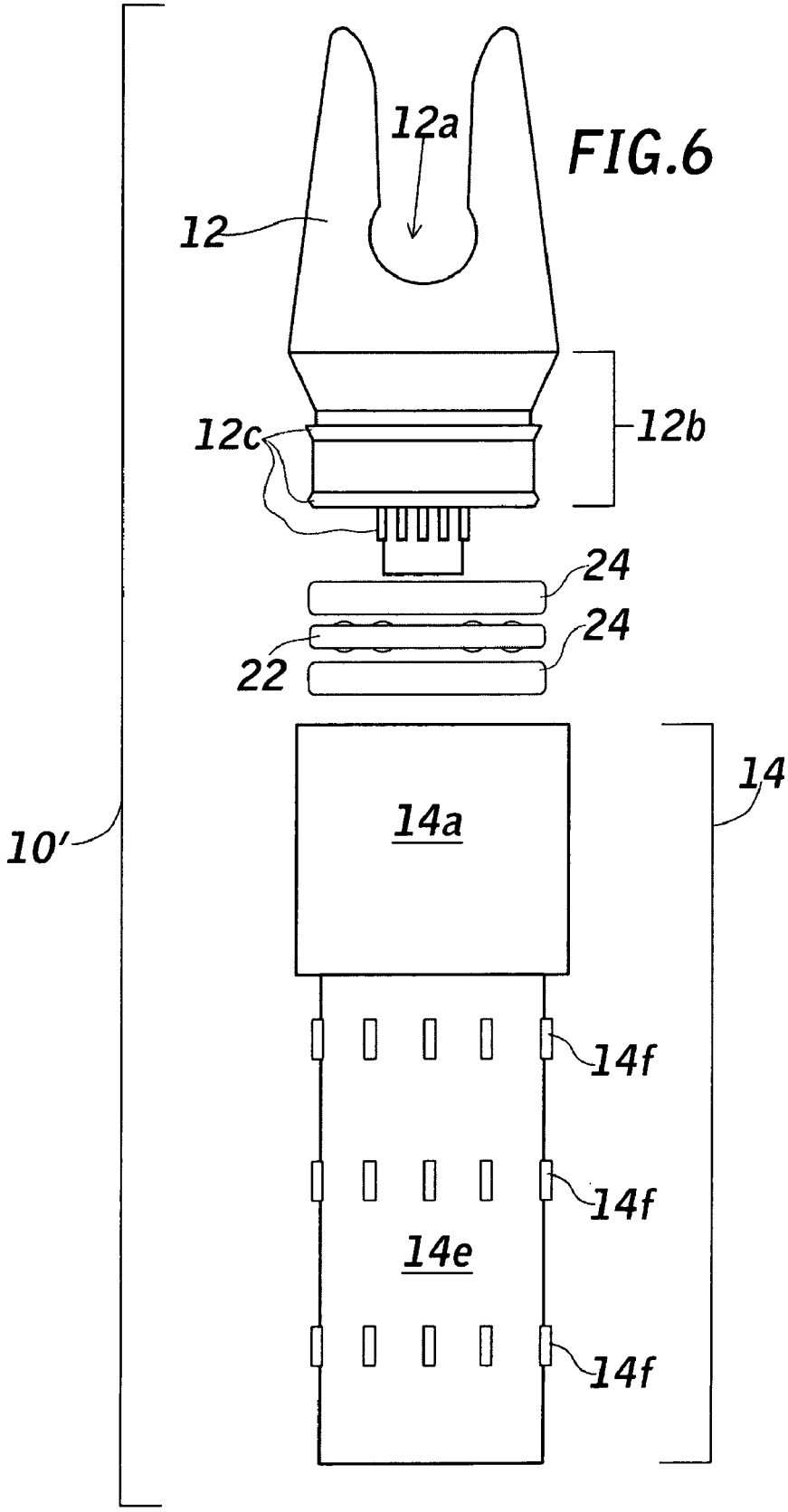
FIG. 6 is a exploded view of one preferred embodiment according to the present invention depicting a nock assembly with a nock 12, and retainer 14.
Figure 7:
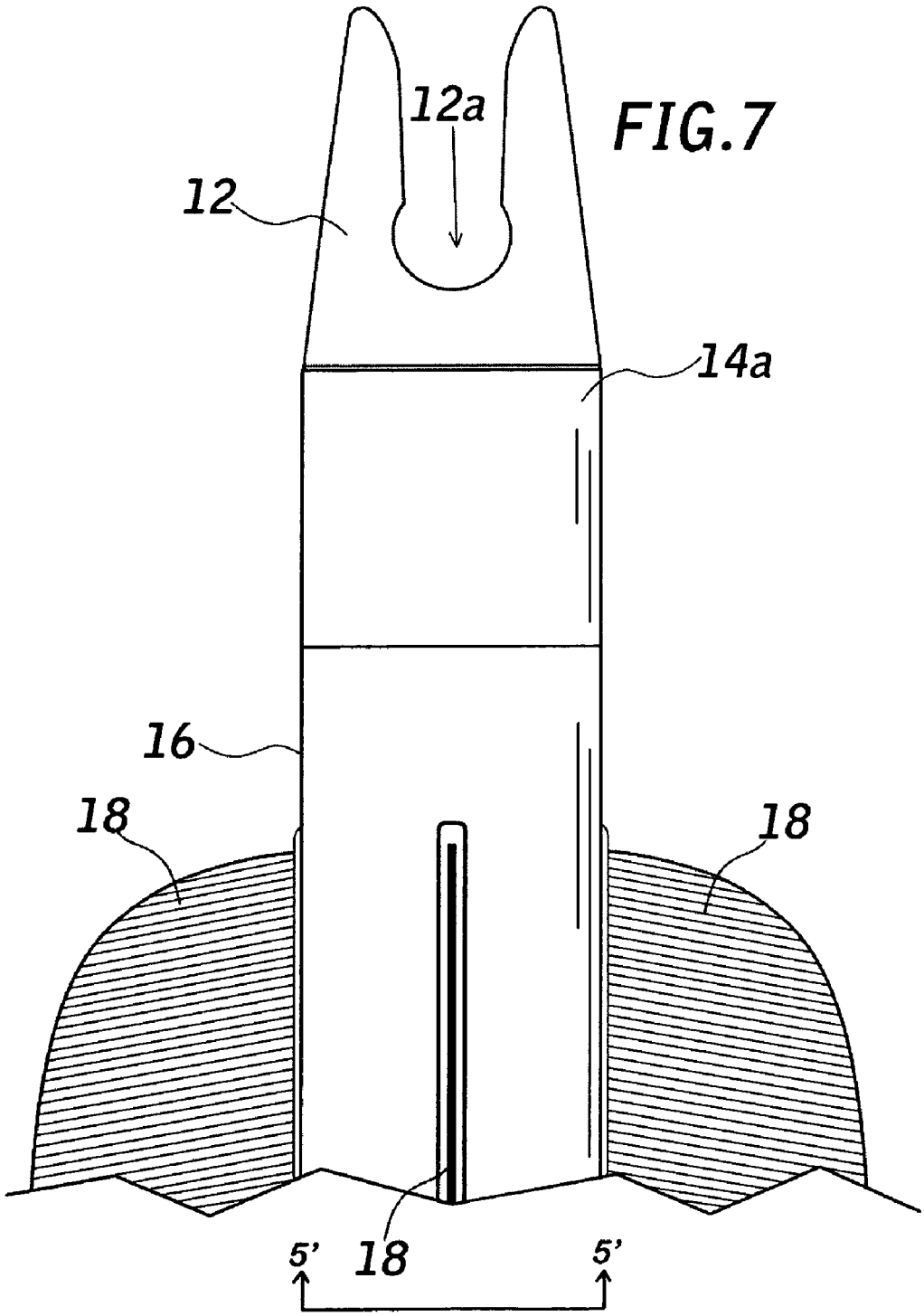
FIG. 7 is a plan view of the embodiment of (FIG. 6) depicting a nock assembly with a nock 12, and a collar mounted to an arrow shaft 20.
Figure 8:
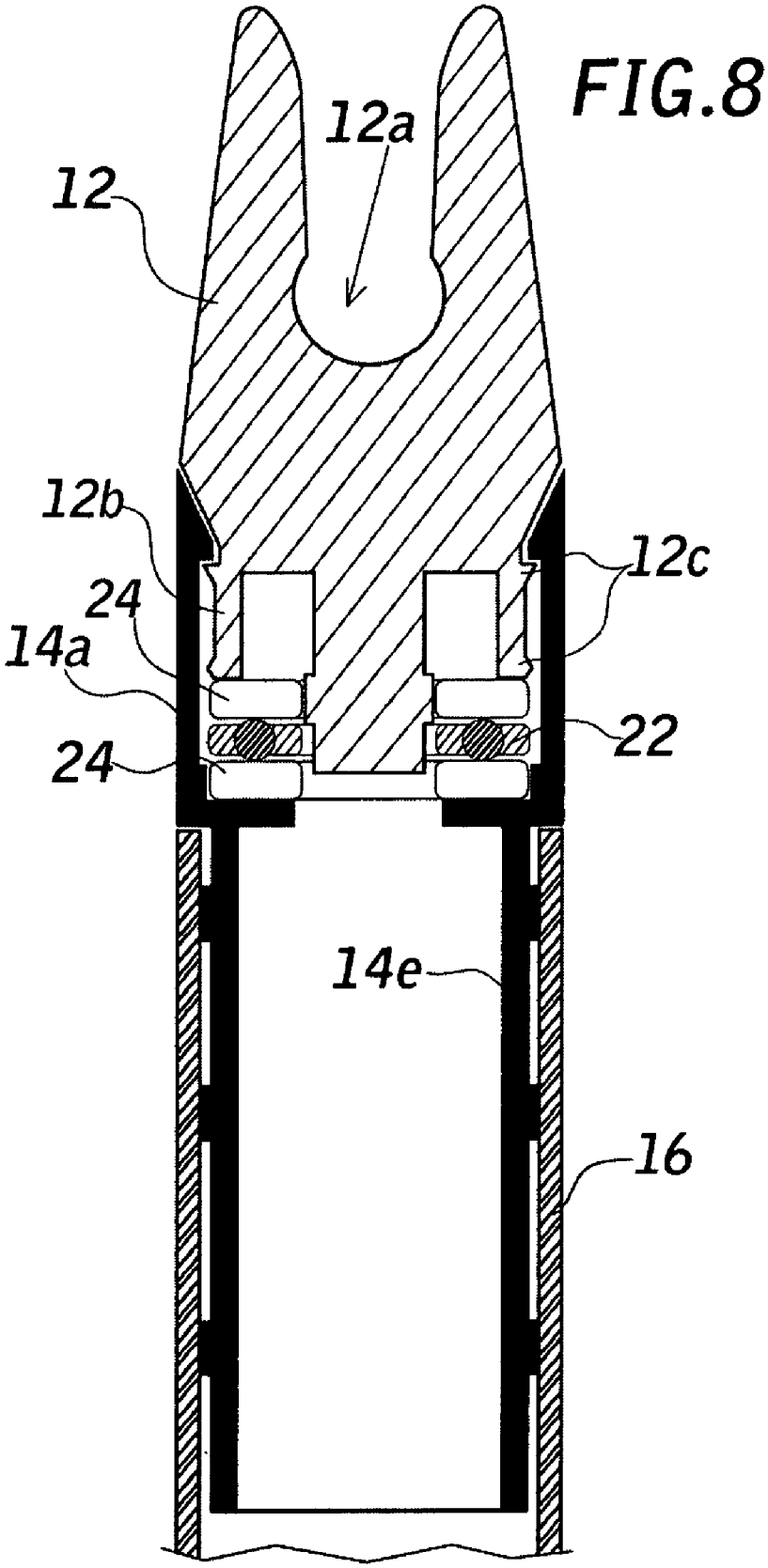
FIG. 8 is a sectional view taken along lines 5'-5' of (FIG. 7)
Figure 9:
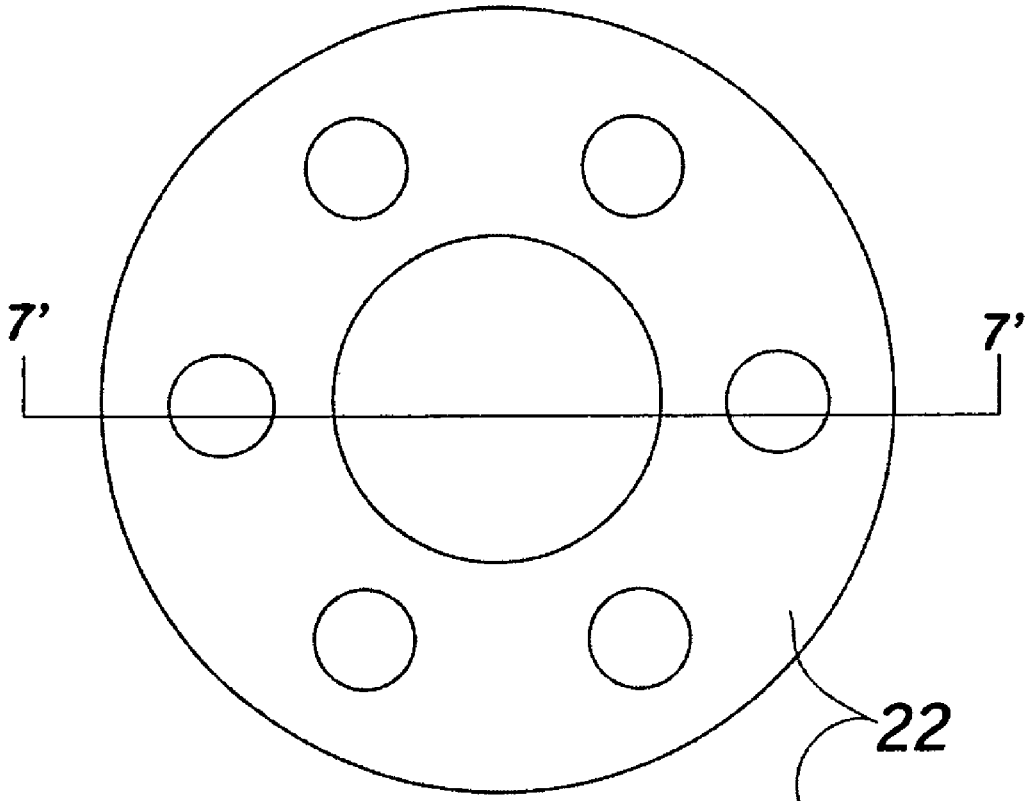
FIG. 9 is a plan view of a typical thrust bearing 22.
Figure 10:
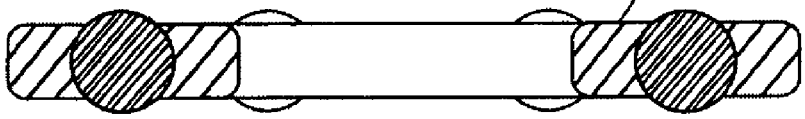
FIG. 10 is a sectional view taken along lines 7'-7' of (FIG. 9).

10' nock assembly
12 nock
12*a* bowstring rest
12*b* nock base
12*c* nock spacers
12*d* nock bottom
13 bow string
14 retainer assembly
14*a* collar
14*b* upper annulus
14*c* lip
14*d* lower annulus
14*e* bottom portion retainer
14*f* tabs
16 arrow shaft
18 fletching
22 thrust bearing
24 spacers Referring generally to FIGS. 1-10; a preferred embodiment according to the present invention is shown which includes a nock segment 12 with a bowstring rest 12*a*, a base portion 12*b* with a series of concentric ridges 12*c* serving as an alignment and spacing means for the nock segment, a retainer assembly 14, including a collar 14*a* portion possessing an upper annulus 14*b* and an lower annulus 14*d*, and a cylindrical retainer bottom 14*e* with an upper portion of reduced diameter for fitting inside the collar 14*a* and a bottom portion for fitting into one end of an arrow shaft 16. The collar 14*a* has a circumjacent lip 14*c* that reduces the diameter of the upper annulus 14*b* and acts to prevent the nock segment from longitudinal movement. Cavities within the nock segment 12 and the retainer bottom 14*e* reduce the weight of the assembly. The ridges 12*c* serve to maintain a clearance between the nock base 12*b* and the interior of the collar 14*a* when the nock is spinning. While the particular embodiment shown is intended for insertion into the end of a hollow arrow shaft 16 in which the tabs 14*f* about the retainer bottom 14*e* produce a friction fit with the interior wall of the arrow shaft, it is possible that the retainer assembly 14 may be modified to screw into the end of an arrow shaft or be affixed thereto by other means as would be appreciated by one of skill in the art. The nock assembly can be part of the arrow shaft produced in situ by the manufacturer, or retrofitted to the arrow shaft by the consumer.

When assembling the nock assembly, the lower annulus 14*d* is affixed to the upper portion of retainer bottom 14*e* and nock 12 is irreversibly pressed through the upper annulus of the collar which forces ridges 12*c* past the beveled circumjacent lip 14*b*. The profiles of the ridges prevent the nock base from being pulled out once it is secured within the collar. The collar is sonically welded to the upper portion of the retainer bottom or is affixed by gluing or other appropriate means.

The nock base 12*b* contained within the collar 14*a*, is unconnected to the upper portion of the retainer bottom and can spin freely within the collar. Preferably the retainer and nock are constructed of a material with a low coefficient of friction such as Delrin®. Preferably, clearances between the nock base and the interior wall of the collar, and the clearances between the bottom of the nock and the upper portion of the shaft attachment range from 0.002 in. to 0.010 in.

Referring to FIGS. 6-10, a thrust bearing 22 between a set of washers 24 resides between the nock base 12*b* and the upper portion of the retainer bottom 14*e*.

Once the spin-nock is coupled to an arrow shaft, the arrow can be used like any other. The spin-nock works similarly to a conventional fixed nock with the exception that the nock segment 12 spins independently of the arrow allowing the fletching 18, and thus the entire arrow shaft, to begin spinning upon release of the bowstring from the fingers or a bowstring release, resulting in increased stabilization for the arrow. Preferably a drop-away type arrow rest such as the Ripcord® arrow rest may be used to aid in fletching clearance thus permitting the use of larger helical fletching configurations which promote greater spin and stability especially when using larger broadheads.

Again, referring to FIG. 1, a helical type fletching 18 configuration is shown rotating independently of the nock segment 12 based approximately on a rate of 1 rotation per 3 feet of travel where (t1, t2, t3) represent respectively, a fully drawn bow string, the bow string mid release and the bow string at the instant of arrow release.

Although the foregoing description sets forth a preferred embodiment tailored to fit current tubular arrow shafts, as would be appreciated by those in the art, the retainer bottom 14*e* of the retainer assembly 14 may be produced with a larger diameter and shortened to fit over the end of a solid arrow shaft with the retainer bottom possessing a mating recess, or conversely, the retainer bottom may reduced to fit into a mating recess at the end of the arrow shaft. The mating portions of the arrow shaft and the retainer bottom can be threaded as required. While the invention has been described by the embodiments given, it is not intended to limit the scope of the invention to the particular form set forth, but on the contrary, it is intended to cover such alternatives, modifications, and equivalents as may be included within the spirit and scope of the invention as defined by the appended claims.

I claim:

1. An interlocking nock assembly for an arrow shaft with fletching comprising:

1) a retainer portion affixed to one end of the arrow shaft including
   a) at least a collar portion,
   b) a bottom portion; and,
2) a nock portion having
   a) a bowstring rest portion,
   b) a base portion surrounded by the collar portion, with spacing means separating the base from the bottom portion of the retainer, and, wherein the base portion is constrained within the retainer portion to spin unimpededly in a substantially logitudinally fixed position relative to the retainer portion when the shaft is rotated by the fletching turning through the air.

2. The assembly according to claim 1 in which at least one bearing surface resides between the nock portion and the collar.

3. A method of producing a freewheeling nock assembly in combination with an arrow shaft comprising the steps:

1) forming a retainer with inner and outer surfaces and divided into a relatively larger diameter portion and a reduced diameter portion; and,
2) forming a nock including a bowstring rest portion, a base portion and an alignment means which includes at least one spacer having a bearing surface; and,
3) inserting the nock into the larger diameter portion of the retainer, resulting in the alignment means having at least one bearing surface between the base portion and the interior of the retainer which constrains the nock base to spin therein in a substantially longitudinally fixed position relative to the retainer; and,
4) coupling the retainer to the end of the arrow shaft.

* * * * *